US008925559B2

(12) United States Patent
Tiram

(10) Patent No.: US 8,925,559 B2
(45) Date of Patent: Jan. 6, 2015

(54) WIG

(75) Inventor: Aaron Tiram, Lincolnwood, IL (US)

(73) Assignee: Ecoco, Inc., Chicago, IL (US)

( * ) Notice: Subject to any disclaimer, the term of this patent is extended or adjusted under 35 U.S.C. 154(b) by 0 days.

(21) Appl. No.: 13/554,239

(22) Filed: Jul. 20, 2012

(65) Prior Publication Data

US 2014/0020704 A1 Jan. 23, 2014

(51) Int. Cl.
*A41G 3/00* (2006.01)
*A41G 5/00* (2006.01)

(52) U.S. Cl.
CPC ..... *A41G 3/0016* (2013.01); *A41G 3/0041* (2013.01)
USPC ..... 132/201; 132/54; 132/56; 132/53

(58) Field of Classification Search
CPC ..... A41G 3/00; A41G 3/0008; A41G 3/0016; A41G 3/0033; A41G 3/0041; A41G 3/0075; A41G 5/00; A41G 5/004; A41G 5/0073; A41G 5/0053; A45D 8/40
USPC ..... 132/200, 201, 207, 212, 105, 273, 274, 132/53–56; 2/171.4, 171.5, 171.8, 181, 2/183, 204, 207, 209.13, 195.5, 200.1, 2/DIG. 11; 446/394; 434/94; D28/92, 93; D2/866, 871, 873, 874, 875, 877, 880, D2/881, 884, 894
See application file for complete search history.

(56) References Cited

U.S. PATENT DOCUMENTS 1,490,466 A 4/1924 Hupka
1,516,796 A * 11/1924 Seilaz ..... 132/274
1,519,107 A * 12/1924 Breslauer ..... 132/53
1,545,881 A * 7/1925 Cohen ..... 132/54
1,549,334 A * 8/1925 Ruffio ..... 132/105
1,634,190 A 6/1927 Hepner
1,665,380 A * 4/1928 Ruffio ..... 132/105
2,789,567 A 4/1957 Jacoby
3,197,787 A * 8/1965 Toguan et al. ..... 2/171
3,351,073 A * 11/1967 Gregg ..... 2/209.3
3,392,737 A * 7/1968 Fefferman ..... 132/274
3,474,798 A 10/1969 Tillotson
3,557,806 A * 1/1971 Blanchard ..... 132/101
3,613,695 A 10/1971 Kazdin
3,884,248 A * 5/1975 Mendelson et al. ..... 132/53
4,509,539 A 4/1985 Alfieri
4,517,999 A 5/1985 Finamore
4,993,079 A * 2/1991 Johnson ..... 2/181
5,368,052 A 11/1994 Finamore
5,524,650 A * 6/1996 Ponce ..... 132/270
5,551,452 A * 9/1996 Barlow ..... 132/54
5,590,422 A * 1/1997 Henderson ..... 2/171
5,806,535 A 9/1998 Becker
6,830,054 B1 12/2004 Ross-Kuehn
7,343,921 B2 3/2008 Salinas
7,537,014 B1 * 5/2009 Yoo ..... 132/53

(Continued)

*Primary Examiner* — Vanitha Elgart

(74) *Attorney, Agent, or Firm* — Wood, Phillips, Katz, Clark & Mortimer

(57) ABSTRACT

A wig having a body with an inside surface for engaging a user's head and an outside surface. The outside surface has hair strands projecting therefrom. The body is placeable in an operative position on the user's head to cover at least a portion of the user's scalp so that the projecting strands give the appearance of natural hair. Through securing structure, the body is reconfigured to allow at least a part of the body to be borne against the user's head with a selectively variable pressure with the body in the operative position.

17 Claims, 6 Drawing Sheets

(56) References Cited

U.S. PATENT DOCUMENTS

| | | | | |
|---|---|---|---|---|
| 8,161,980 | B2 | 4/2012 | Inoue et al. | |
| 8,186,361 | B2 | 5/2012 | Hampton | |
| 8,261,753 | B2 * | 9/2012 | Newman et al. | 132/54 |
| D690,469 | S * | 9/2013 | Christianson | D28/92 |
| 2002/0189627 | A1 * | 12/2002 | Tang | 132/53 |
| 2003/0131861 | A1 * | 7/2003 | Prestia | 132/53 |
| 2004/0168696 | A1 | 9/2004 | Cox | |
| 2006/0174905 | A1 | 8/2006 | Bias | |
| 2007/0034221 | A1 * | 2/2007 | Chung | 132/53 |
| 2008/0178902 | A1 | 7/2008 | Moeszinger | |
| 2009/0133710 | A1 * | 5/2009 | Wee | 132/274 |
| 2009/0235943 | A1 | 9/2009 | Sugai et al. | |
| 2010/0065078 | A1 | 3/2010 | Reece | |
| 2011/0023903 | A1 * | 2/2011 | Kezios | 132/201 |
| 2011/0067719 | A1 | 3/2011 | LaDue | |
| 2011/0168196 | A1 | 7/2011 | Freelove | |
| 2011/0186065 | A1 | 8/2011 | Inoue et al. | |
| 2012/0222692 | A1 * | 9/2012 | Ray | 132/53 |
| 2013/0019889 | A1 * | 1/2013 | Palmer-Rogers | 132/201 |
| 2014/0000641 | A1 * | 1/2014 | Lewis et al. | 132/201 |

* cited by examiner

WIG

BACKGROUND OF THE INVENTION

1. Field of the Invention

This invention relates to wigs and, more particularly, to a wig that can be borne against a user's head with a selectively variable pressure.

2. Background Art

Wigs have been worn for decades for many different reasons. Some wearers enjoy the convenience of donning a wig to allow instantaneous selection of a hair style and/or color without the inconvenience associated with maintaining and styling the wearer's natural hair. The wigs may be worn over the wearer's natural hair that may have a substantial length. Alternatively, a wearer may choose to closely crop his/her hair to allow a closer conformance of the wig to the wearer's scalp.

Wigs worn in this fashion do have some drawbacks. One of the most significant problems with wigs is that they tend to shift on a wearer's head, particularly when the wearer engages in certain activities and/or is exposed to the elements, such as high winds, etc.

One attempted solution to this problem is to tightly conform the head-engaging surface on the wig to the wearer's head. A certain amount of elasticity may be built into the wig to accommodate some size variation. However, head sizes may vary significantly from one wearer to the next. It is not practical to keep on hand all hair styles and colors in the many anticipated sizes that may be needed. Thus, inventory control becomes problematic. From the standpoint of the purveyor, excess inventory of certain wig styles and colors may remain on hand; whereas, from a consumer standpoint, desired styles and colors may not be available, whereby the potential purchaser is left with the options of either not making the purchase or settling for a product that is less than optimal.

A further problem with this design is that the head-engaging layer, if stretchable, may eventually lose its memory. The material may stretch to the point that it is no longer practical to wear the wig, which necessitates a further purchase. This problem is aggravated when the wig is worn over lengthy hair and subsequently worn over hair that has been cut to a significantly shorter length. The wig may stretch permanently to accommodate the mass of longer hair and may thereafter fit loosely upon the wearer's head with the hair cropped.

In short, it is very difficult to make available to consumers a range of hairstyles and colors in wigs that will snugly embrace a wearer's head without uncomfortable pressure over a relatively lengthy useful life.

Oftentimes, persons will have localized hair loss or thinning hair, whereas the hair may be relatively full at other areas. This condition may be the result of natural hair loss or hair loss induced by use of topical chemicals or chemicals used during medical treatment.

Heretofore, the main option to address such conditions has been to wear a full wig that covers not only the troubled areas but the areas where there is thick hair. An individual may opt to closely crop all of his/her hair or leave the natural hair at a substantial length.

In the latter case, one contends with the difficulty of avoiding shifting of the wig on the head. In the former case, the cutting of the hair commits the individual to either wearing a wig at all times or exposing hair that is cut to a length that is much less than desirable.

By wearing a full wig, the wearer also contends with other problems associated with the full coverage of the scalp region. That is, provision must be made to prevent shifting of the wig. Further, the wig, regardless of its construction, causes some level of discomfort in terms of irritation and confining heat on the user's head.

The industry continues to seek out wig designs that overcome one or more of the above problems. Notwithstanding this effort, in a very mature industry, at least the above problems persist.

SUMMARY OF THE INVENTION

In one form, the invention is directed to a wig having a body with an inside surface, for engaging a user's head, and an outside surface. The outside surface has hair strands projecting therefrom. The body is placeable in an operative position on a user's head to cover at least a portion of a user's scalp so that the projecting strands give the appearance of natural hair. Securing structure is provided through which the body is reconfigured to allow at least a part of the body to be borne against a user's head with the selectively variable pressure with the body in the operative position.

In one form, the body has a front wall that is contiguous with spaced first and second side walls. The front and first and second side walls define a rearwardly opening "U" shape.

In one form, the first and second side walls have rear portions that are overlapped with each other with the body in the operative position.

In one form, the securing structure has separate components on the first and second side walls that cooperate with each other to allow the body to be borne against a user's head with a selectively variable pressure with the body in the operative position.

The separate components may be in the form of straps that are tied together.

The separate components may have cooperating connector parts.

In one form, the separate components are releasably joinable to each other.

The straps may be contiguous with a respective side wall.

In one form, the body is in the form of a band that extends around a user's head.

The body may have a width of from 1 to 4 inches.

In one form, the body has a multi-layer construction with a first material defining at least a part of the inside surface and a second material, different than the first material, defining at least a part of the outside surface from which the hair strands project.

In one form, the second material is a mesh material into which the hair strands are woven.

The body may have a multi-layer construction with a first material defining at least a part of the inside surface and a second material, different than the first material, defining at least a part of the outside surface from which the hair strands project. The at least one of the straps has inside and outside surface portions made from a material that is different than the second material.

The inside and outside surface portions of the at least one strap may be made from the first material.

In one form, the straps have outside surface portions from which the hair strands project.

In one form, at least a part of at least one of the body and securing structure is made from an elastic material that stretches as the body is reconfigured to allow at least a part of the body to be borne against a user's head with a selectively variable pressure.

In one form, the invention is directed to a method of using a wig, as described above, to cover at least a portion of a user's scalp where there is thin, or no, hair. According to the method, the body is operatively placed on the user's head so that the first and second side walls of the body are against the sides of the user's head and the front wall of the body is against a front and top region of the user's head. After operatively placing the body, through the securing structure, the body is reconfigured to bear at least a part of the body against the user's head with an increasing pressure.

In one form, the first and second side walls have rear portions that are overlapped with the body in the operative position. The method further includes the step of changing a degree of overlap of the rear portions of the first and second side walls through the securing structure.

In one form, the step of operatively placing the body involves operatively placing the body so that the body extends continuously between first and second side walls over a top region of the user's head.

The step of operatively placing the body may involve operatively placing the body so that the body is open at a top region of the user's head.

DETAILED DESCRIPTION OF THE PREFERRED EMBODIMENT

Figure 1:
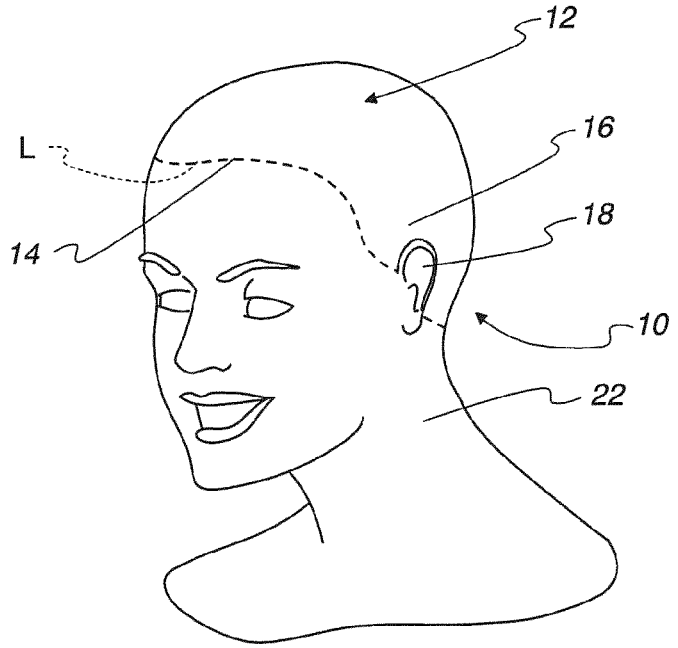
FIG. 1 is a perspective view of a user's head and identifying a scalp region over which a wig, according to the invention, can be placed to give the appearance of natural hair.
Figure 2:
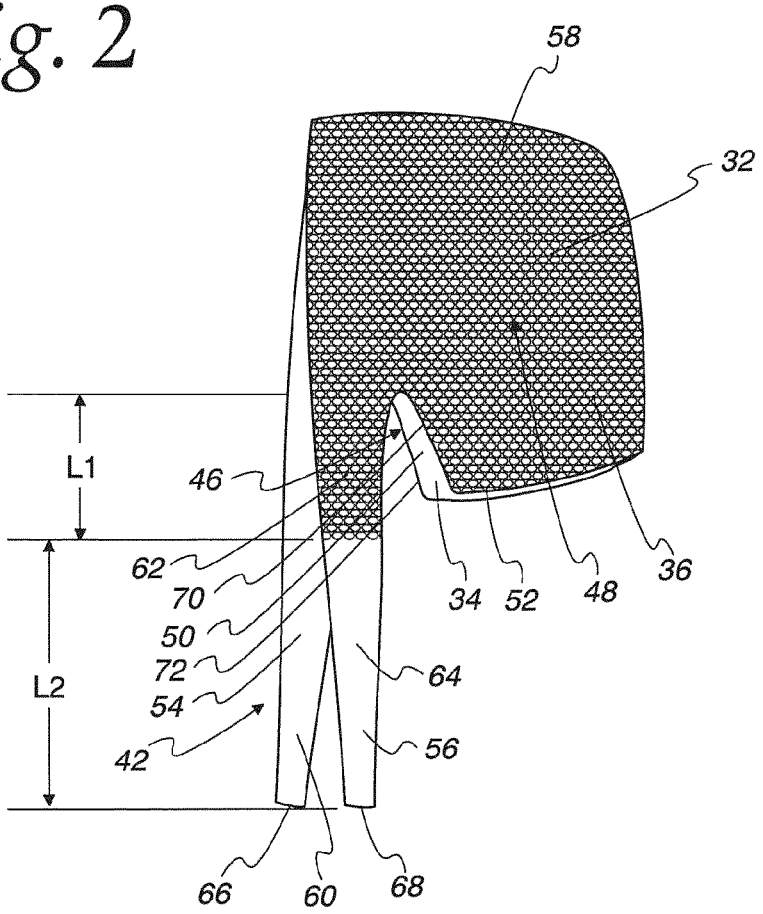
FIG. 2 is a side elevation view of a body on one form of wig, according to the invention, with hair strands omitted.

In FIG. 1, a wig user's head is shown at 10, with a scalp region identified at 12. For purposes of simplicity, the "scalp" will be considered to be the entire surface area on the user's head 10 where hair typically grows. In FIG. 1, the scalp region is bounded by a dotted line L. The scalp 12 extends from the upper forehead 14 to the sides 16 (one shown) around the ears 18 (one shown) and to the back 20 of the wearer's head 10 at the upper region of the neck 22.

A scalp condition may produce extensive hair loss or localized hair loss. The invention contemplates addressing both types of condition. With either condition, it is common for a user to wear a "full wig" that provides hair strands to replicate natural hair growth over the entire scalp region. For example, if there is locally thinning hair, the user may choose to shave his/her head to more comfortably wear a full wig.

In a first exemplary form, as shown in FIGS. 2-6, a wig 30, according to the invention, has a body 32 with an inside surface 34, for engaging the user's head 10, and an outside surface 36. The outside surface 36 has hair strands 40 projecting therefrom. The strands 40 are omitted in FIGS. 2-4 to better allow viewing of the construction and configuration of the body 32.

Figure 4:
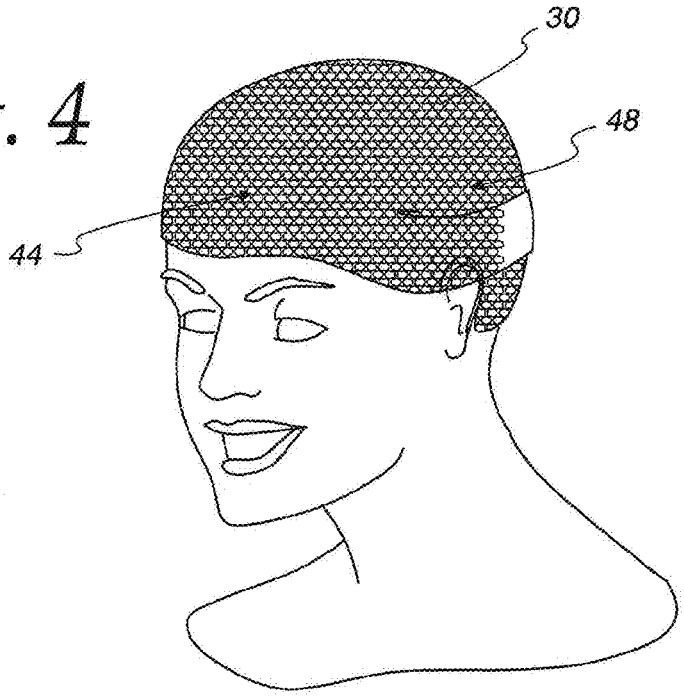
FIG. 4 is a front and side elevation view of the body in the FIG. 3 configuration and operatively positioned on a user.
Figure 5:
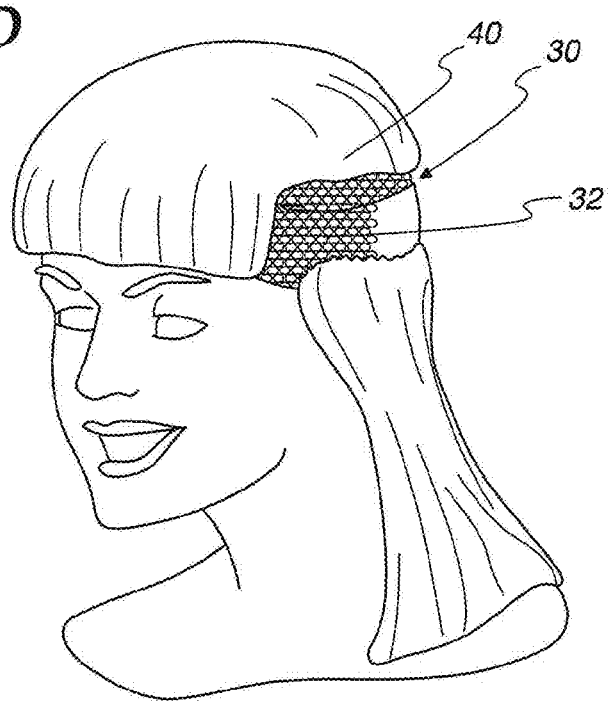
FIG. 5 is a view as in FIG. 4 and incorporating hair strands and with hair strands broken away to show portions of the body.
Figure 6:
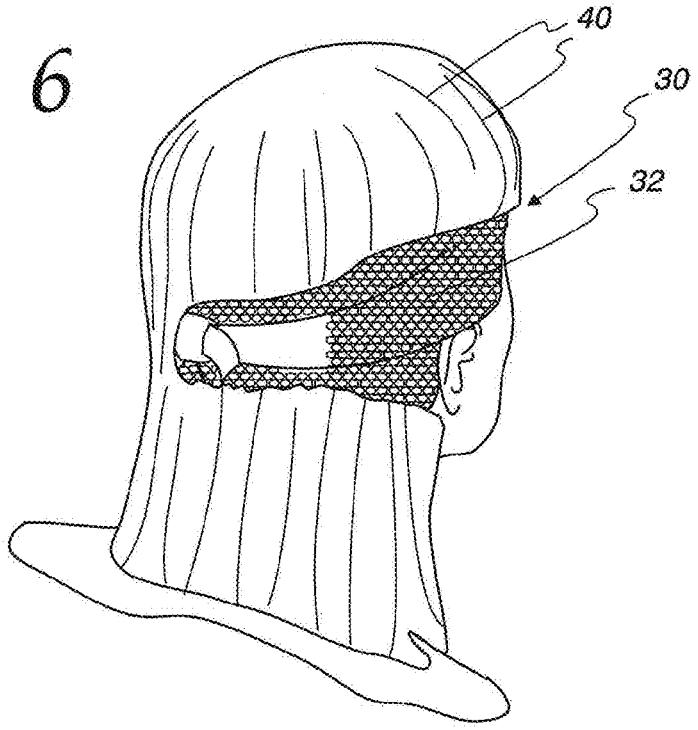
FIG. 6 is a view as in FIG. 5 from a different perspective and with different portions of hair strands broken away.

The body 32 is placeable in an operative position on the user's head 10, as shown in FIGS. 4-6, wherein it covers at least a portion, and in this case a majority, of the total area of the user's scalp 12 so that the projecting strands 40 give the appearance of natural hair thereat.

Securing structure at 42 is provided through which the body 32 is reconfigured to allow at least a part of the body 32 to be borne against the user's head 10 with a selectively variable pressure with the body 32 in the operative position.

The body 32 has a front wall 44 that is contiguous with spaced first and second side walls 46, 48. The front and side walls 44, 46, 48 cooperatively define a rearwardly opening "U" shape. With the body 32 in its operative position, the inside of the front wall 44 bears against the scalp at the forehead 14, with the side walls 46, 48 bearing one each against the opposite sides 16 of the user's head 10.

The first and second side walls 46, 48 respectively have rear portions 50, 52. The rear portions 50, 52 are overlapped with each other at the rear of the body, as seen most clearly in FIG. 3. Through the securing structure 42, the degree of overlap is changed to thereby vary the effective encircling diameter of the body 32.

In this embodiment, the securing structure 42 is in the form of separate components that are each in the form of an elongate strap 54, 56, associated one each with the first and second side walls 46, 48. In this embodiment, the straps 54, 56 are also respectively contiguous with the side walls 46, 48, respectively.

Figure 3:
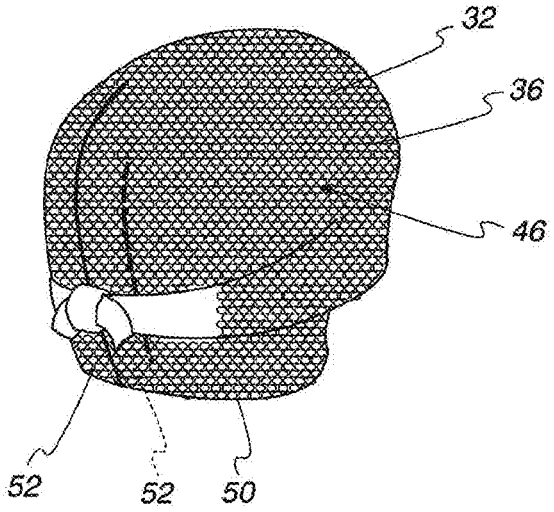
FIG. 3 is a rear and side elevation view of the body in FIG. 2 as it is configured when operatively positioned on a user's head and tightened thereagainst.

The straps 54, 56 can be tied together, as seen in FIGS. 3 and 6. By tightening the tied straps 54, 56, the body 32 can be borne more positively against the user's head. The pressure can be selectively released and the straps 54, 56 fully separated from each other, as to facilitate separation of the wig 30 and prepare for the next placement of the wig 30 on the user's head.

The body 32 is shown with a multi-layer construction with a first material defining at least part of the inside surface 34 and a second material, different than the first material, defining at least a part of the outside surface 36 from which the hair strands 40 project. The multi-layer construction, while preferred, is not required.

In one preferred form, the second material is shown at 58 with a mesh construction which facilitates hair strand connection, as through a weaving operation. No details of the weaving of the individual strands is described herein, as this process is well known to one skilled in the art. Further, the hair strands 40 could be attached by other suitable means, including adhesives, etc.

The first material is selected primarily for user comfort. The first material is preferably softer than the second material 58. The first material may be selected from a wide range of materials, including those commonly used to contact wearers' scalps in conventional headwear constructions. Conventional materials used for headband construction are also suitable.

In the depicted embodiment, the first material defines the entire inside surface 34, including inside surface portions on the straps 54, 56, with one exemplary inside surface portion shown at 60 for the strap 54. The straps 54, 56 preferably have the same construction.

On the exemplary strap 56, the second material 58 extends along an outside surface portion 62 over a distance L1 beginning from the location where the strap 56 projects from the side wall 48. The remaining portion of the outside surface 64 is made from a non-mesh material that may be a material, that is different than the first material, or the first material itself. This outside surface portion 64 has a length L2 which is adequate to define at least a majority of the lengths of the straps 54, 56 that interact as they are tied. Using a material other than the second material 58 may facilitate tying without hang-up. The material making up the strap lengths L2 can be selected by one skilled in the art to facilitate tying while offering sufficient resistance to untying that the wig 30 will not have a tendency to become unintentionally loosened on the user's head.

The strap lengths L2 also taper towards free ends 66, 68 to facilitate tying and so that the straps 54, 56 do not, when tied, take up significant areal space from which hair strands 40 might project.

In the depicted embodiment, on one exemplary side of the body 32, there is a rearwardly opening U-shaped recess 70. This recess 70, and a corresponding recess 72 on the opposite body side, permit the rear portions 50, 52 to progressively overlap without bunching of the body 32 as the straps 54, 56 are tightened.

The top of the body 32 can be made with a contiguous, uninterrupted shape. Alternatively, the side walls 46, 48 may extend into overlapping relationship at the top of the body 32 or be joined at a seam.

Figure 7:
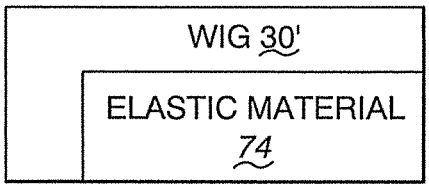
FIG. 7 is a schematic representation of a modified form of wig, according to the invention, incorporating elastic material.

The body 32 and/or securing structure thereon may be made partially or wholly with materials that are elastic in nature. The elastic material may be strategically located or incorporated throughout a substantial part, or the entirety, of the areal extent of the outside surface 36 of the body 32 and securing structure 42. This may facilitate more comfortable fitting of the wig 30 to the user's head. Since elastic material has a tendency to lose memory, virtually the entire body 32 could be made from a substantially inextensible material. The ability to tighten the body against the wearer's head through the securing structure 42 potentially obviates the need for such elastic material. The elastic material is shown generically in FIG. 7 at 74 on a wig 30'. This generic showing is intended to encompass elastic material incorporated into all or part of the body 32 and/or securing structure 42 thereon.

Figure 8:
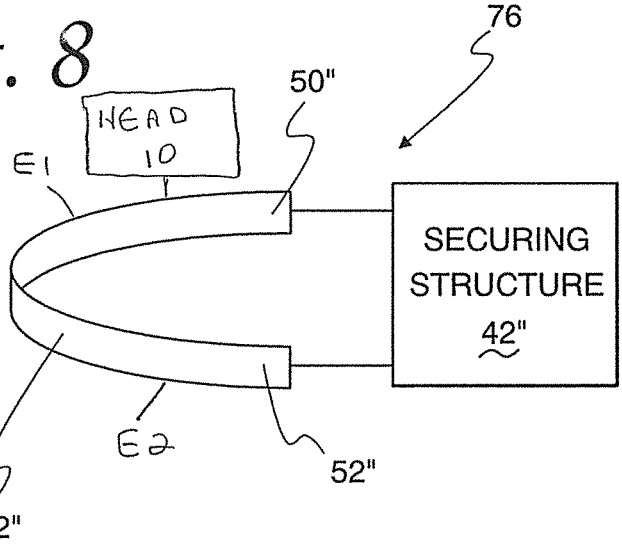
FIG. 8 is a partially schematic representation of a modified form of body and cooperating securing structure that produce a band, according to the invention.

The invention also contemplates that the body 32" may make up part of a band 76, as shown in FIG. 8 with a width between top and bottom free edges E1, E2, with the user's head exposed above the open top edge E1 with the body 32" in its operative position. The body 32" extends around a user's head, as from the forehead region to against the sides 16 over the ears 18. Securing structure 42" is utilized to interact with rear portions 50", 52", corresponding to the rear portions 50, 52 on the wig 30. The securing structure 42" may take any form, as described above, or any of the other forms described hereinbelow and, in conjunction with the body 32", defines an encircling shape for the band 76.

In FIG. 8, the body 32" has a width preferably of 1-4 inches, but could be narrower or wider. While a constant width is contemplated, it is also contemplated that the width may vary throughout the length of the band 76, as to accommodate a particular scalp condition.

Figure 9:
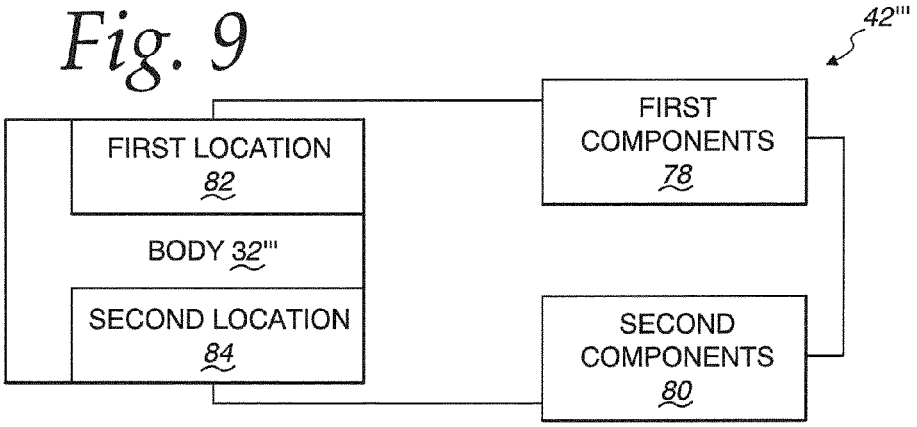
FIG. 9 is a schematic representation of a wig body and securing structure associated therewith according to the invention.

The securing structure 42, 42" is not limited to the straps 54, 56 shown. As shown schematically in FIG. 9, a generic form of the securing structure 42''' consists of first and second components that respectively connect to first and second locations 82, 84 on a body 32''', representative of the bodies 32, 32", and other body configurations. The first and second components 78, 80 may cooperate in any manner to change an effective encircling diameter of a band, defined partially or entirely by the body 32'''.

Figure 10:
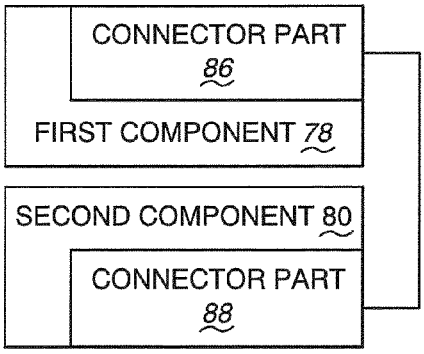
FIG. 10 is a schematic representation of the securing structure in FIG. 9 and showing additional detail thereof.

As shown in FIG. 10, the first and second components 78, 80 may have connector parts 86, 88, respectively, that can be engaged to produce a desired, effective, encircling diameter for the wig band 32'''.

The generic showing of these components 78, 80 is provided so as not to limit the components 78, 80 to any, particular, part or mechanism. For example, snaps, buckles, slides, hook-and-loop fasteners, press fit pins, etc., are all within the scope of the invention.

While the components 78, 80 are ideally releasable, they might be permanently joined with a selected effective encircling diameter.

Figure 11:
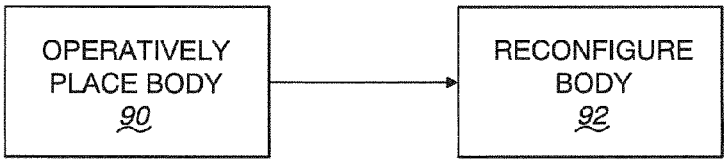
FIG. 11 is a flow diagram representation of a method of using a wig, as shown in the Figures hereinabove.

The invention also contemplates a method of using a wig as described in various forms above. As shown in flow diagram form in FIG. 11, the body is operably placed on the user's head, as shown at block 90, so that the first and second side walls of the body are against the side of a user's head and the front wall of the body is against a front and top region of a user's head. As shown at block 92, after operatively placing the body, the body is reconfigured through the securing structure to bear at least a part of the body against the user's head with an increasing pressure.

If the embodiment is utilized with the rear side wall portions overlapped, the securing structure is utilized to change the degree of overlap of the rear portions.

Figure 12:
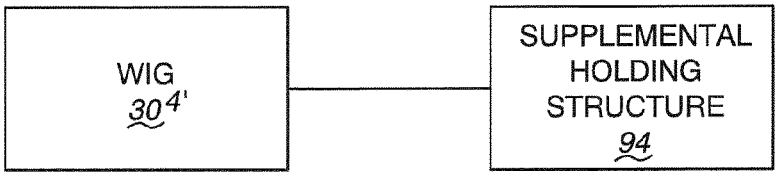
FIG. 12 is a schematic representation of a wig incorporating a supplemental holding structure.
Figure 13:
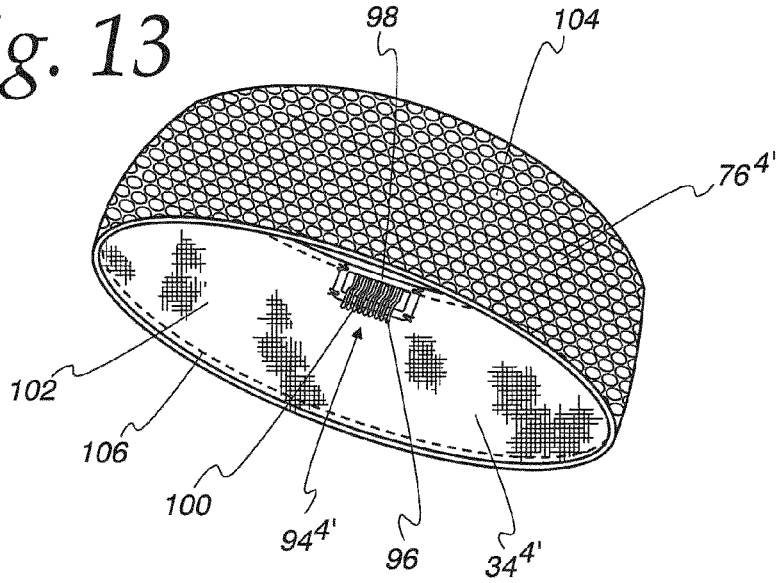
FIG. 13 is a perspective view of a wig band incorporating one specific form of supplemental holding structure.
Figure 14:
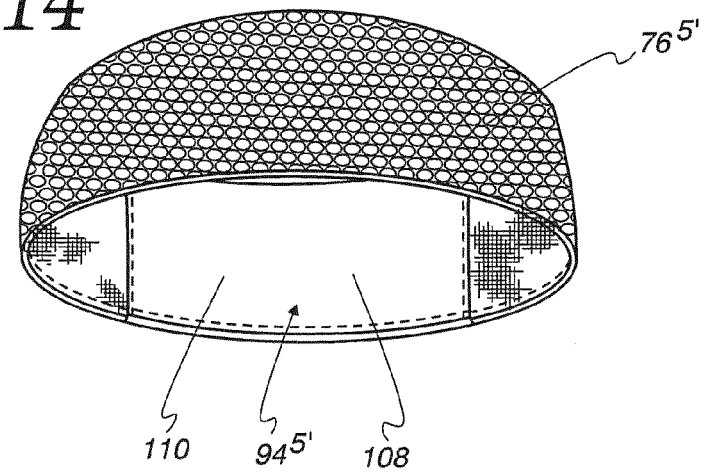
FIG. 14 is a perspective view of another wig band incorporating an alternative construction for a supplemental holding structure.

As shown in FIGS. 12-14, the invention also contemplates the use of a supplemental holding structure as shown schematically at 94 for a wig shown at $\mathbf{30}^{4'}$, intended to encompass all of the embodiments disclosed herein, and others. While all of the aforementioned wigs can be shaped and dimensioned to be capable of maintaining themselves upon the user's head, as an additional safeguard, the supplemental holding structure 94 can be utilized.

In FIG. 13, one specific form of supplemental holding structure is shown at $\mathbf{94}^{4'}$ on a band $\mathbf{76}^{4'}$. The supplemental holding structure $\mathbf{94}^{4'}$ consists of a series of tines 96 that produce a comb-like arrangement that can be passed through the user's existing hair to produce a holding force. In this embodiment, the tines 96 project in cantilever fashion from a circumferentially extending base 98 in parallel, spaced relationship. The tines 96 are shown with a bent configuration that allows the leading ends 100 thereof to be spaced radially inwardly from the inside surface $\mathbf{34}^{4'}$. One or more additional comb arrangements can be placed circumferentially around the band $\mathbf{76}^{4'}$.

In this embodiment, the band $\mathbf{76}^{4'}$ has a multi-layer construction with inside and outside layers 102, 104 joined by stitching 106. The nature of the materials defining the layers is not critical to the incorporation of the supplemental holding structure 94.

In FIG. 14, a further modified form of band $\mathbf{76}^{5'}$ is shown with the supplemental holding structure $\mathbf{94}^{5'}$ in the form of a discrete patch 108 incorporated into the inside of the band $\mathbf{76}^{5'}$. The patch 108 has a head-engaging surface 110 that incorporates an adhesive that can be releasably bonded to the user's head. The size of the patch 108, its precise shape, etc., are not critical and can be changed considerably within the scope of the inventive teachings. More than one patch 108 could be utilized.

Alternatively, the surface 110 may be tacky, or otherwise have a high coefficient of friction.

The schematic showing of the supplemental holding structure 94 is intended to incorporate the specific supplemental holding structures 94$^{4'}$, 94$^{5'}$ in FIGS. 13 and 14 and virtually an unlimited number of different structures that perform a like function.

With the different embodiments, the user can select between placing the body over the top region of the head and continuously between the first and second side walls of the body, or leaving that region open.

The foregoing disclosure of specific embodiments is intended to be illustrative of the broad concepts comprehended by the invention.

The invention claimed is:

1. A wig comprising:

a body having an inside surface for engaging a user's head and an outside surface that is exposed with the wig worn by a user, the outside surface having hair strands woven thereinto and projecting therefrom, the body placeable in an operative position on a user's head to cover at least a portion of a user's scalp so that the projecting strands give the appearance of natural hair; and securing structure through which the body is reconfigured to allow at least a part of the body to be borne against a user's head with a selectively variable pressure with the body in the operative position, wherein the body has a front wall that is contiguous with spaced first and second side walls, the front and first and second side walls defining a rearwardly opening "U" shape, wherein the first and second side walls have rear portions that are overlapped with each other with the body in the operative position to different degrees to thereby vary an effective encircling diameter of the body, wherein the securing structure overlies the overlapped rear portions.

2. The wig according to claim 1 wherein the securing structure comprises separate components, on the first and second side walls, that cooperate with each other to allow the body to be borne against a user's head with a selectively variable pressure with the body in the operative position.

3. The wig according to claim 2 where the separate components are each straps that can be tied together.

4. The wig according to claim 2 wherein the separate components have cooperating connector parts.

5. The wig according to claim 2 wherein the separate components are releasably joinable to each other.

6. The wig according to claim 3 wherein the straps are contiguous with a respective side wall.

7. The wig according to claim 1 wherein the body is in the form of a band that extends around a user's head.

8. The wig according to claim 7 wherein the body has a width of from 1-4 inches.

9. The wig according to claim 1 wherein the body has a multi-layer construction with a first material defining at least a part of the inside surface and a second material, different than the first material, defining at least a part of the outside surface from which the hair strands project.

10. The wig according to claim 9 wherein the second material is a mesh material into which the hair strands are woven.

11. A wig comprising:

a body having an inside surface for engaging a user's head and an outside surface, the outside surface having hair strands projecting therefrom, the body placeable in an operative position on a user's head to cover at least a portion of a user's scalp so that the projecting strands give the appearance of natural hair; and securing structure through which the body is reconfigured to allow at least a part of the body to be borne against a user's head with a selectively variable pressure with the body in the operative position, wherein the body has a front wall that is contiguous with spaced first and second side walls, the front and first and second side walls defining a rearwardly opening "U" shape, wherein the first and second side walls have rear portions that are overlapped with each other with the body in the operative position, wherein the securing structure comprises separate components, on the first and second side walls, that cooperate with each other to allow the body to be borne against a user's head with a selectively variable pressure with the body in the operative position, wherein the separate components are each straps that can be tied together, wherein the body has a multi-layer construction with a first material defining at least a part of the inside surface and a second material, different than the first material, defining at least a part of the outside surface from which the hair strands project, wherein at least one of the straps has inside and outside surface portions made from a material that is different than the second material.

12. The wig according to claim 11 wherein the inside and outside surface portions of the at least one strap are made from the first material.

13. The wig according to claim 11 wherein the straps have outside surface portions from which the hair strands project.

14. The wig according to claim 1 wherein at least a part of at least one of the body and securing structure is made from an elastic material that stretches as the body is reconfigured to allow at least a part of the body to be borne against a user's head with a selectively variable pressure.

15. A method of using a wig to cover at least a portion of a user's scalp where there is thinned or no hair, the wig comprising:

a body having a front, a rear, an inside surface for engaging a user's head and an outside surface, the outside surface made from a mesh material and having hair strands woven into the mesh material and projecting therefrom, the body placeable in an operative position on a user's head to cover at least a portion of a user's scalp so that the projecting strands give the appearance of natural hair; and securing structure through which the body is reconfigured to allow at least a part of the body to be borne against a user's head with a selectively variable pressure with the body in the operative position, wherein the body is in the form of a band that extends fully around a user's head, the band having a width between top and bottom edges, the user's head exposed above the top edge with the body in the operative position, wherein the body has a front wall that is contiguous with spaced first and second side walls, the front and first and second side walls defining a rearwardly opening "U" shape, the method comprising the steps of:

operatively placing the body on the user's head so that the first and second walls of the body are against the sides of the user's head and the front wall of the body is against a front region of the user's head;

after operatively placing the body, through the securing structure reconfiguring the body to bear at least a part of the body against the user's head with an increasing pressure; and changing a degree of overlap of rear portions of the first and second side walls through the securing structure.

16. The method of using a wig according to claim 15 wherein the step of operatively placing the body comprises operatively placing the body so that the body is open at a top region of the user's head.

17. The wig according to claim 15 wherein the securing structure comprises separate components, on and at the rear of the first and second side walls, that cooperate with each other at the rear of a user's head to allow the body to be borne against a user's head with a selectively variable pressure with the body in the operative position.

* * * * *